US008887904B2

(12) United States Patent
Gutierrez

(10) Patent No.: US 8,887,904 B2
(45) Date of Patent: Nov. 18, 2014

(54) FEEDING NIPPLE CONTAINER

(71) Applicant: Henry Alfonso Gutierrez, Lawrenceville, GA (US)

(72) Inventor: Henry Alfonso Gutierrez, Lawrenceville, GA (US)

( * ) Notice: Subject to any disclaimer, the term of this patent is extended or adjusted under 35 U.S.C. 154(b) by 0 days.

(21) Appl. No.: 13/835,939

(22) Filed: Mar. 15, 2013

(65) Prior Publication Data

US 2014/0102919 A1 Apr. 17, 2014

Related U.S. Application Data

(60) Provisional application No. 61/675,873, filed on Jul. 26, 2012.

(51) Int. Cl.

| | |
|---|---|
| ***A61J 9/00*** | (2006.01) |
| ***A61J 11/00*** | (2006.01) |
| ***A61J 9/04*** | (2006.01) |

(52) U.S. Cl.

CPC .. *A61J 9/008* (2013.01); *A61J 9/00* (2013.01); *A61J 11/00* (2013.01); *A61J 9/04* (2013.01); *A61J 11/0075* (2013.01)

USPC ..... 206/221; 206/219; 215/11.5

(58) Field of Classification Search

USPC ..... 206/219, 221, 220, 222; 215/11.1, 11.5, 215/DIG. 8, 11.3; 220/521

See application file for complete search history.

(56) References Cited

U.S. PATENT DOCUMENTS

| | | | | |
|---|---|---|---|---|
| 3,458,076 | A * | 7/1969 | Babcock | 215/6 |
| 3,758,000 | A * | 9/1973 | Mack | 222/143 |
| 4,264,007 | A * | 4/1981 | Hunt | 206/219 |
| 5,419,445 | A | 5/1995 | Kaesemeyer | |
| 5,634,714 | A | 6/1997 | Guild | |
| 5,692,644 | A | 12/1997 | Gueret | |
| 5,794,802 | A | 8/1998 | Caola | |
| 5,836,126 | A | 11/1998 | Harkenrider et al. | |
| 5,863,126 | A | 1/1999 | Guild | |
| 6,257,428 | B1 | 7/2001 | Caola | |
| 7,635,012 | B2 * | 12/2009 | Johns et al. | 141/322 |
| 7,810,661 | B2 * | 10/2010 | Murphy | 215/11.1 |
| 2003/0136790 | A1 * | 7/2003 | McNeeley et al. | 220/793 |
| 2005/0056608 | A1 * | 3/2005 | Nesin | 215/11.1 |
| 2008/0128379 | A1 * | 6/2008 | Hen | 215/11.5 |
| 2008/0156763 | A1 * | 7/2008 | Murphy | 215/11.1 |

* cited by examiner

*Primary Examiner* — Steven A. Reynolds

(74) *Attorney, Agent, or Firm* — Mark R. Malek; Zies Widerman & Malek

(57) ABSTRACT

A container for storing and dispensing a substance including a deformable nipple having an open end, a feeding tip and a storage cavity; a lid adapted to releasably engage the open end of the nipple; and a (optionally) a tether having resilient properties, the tether connecting the nipple to the lid; wherein, in a storage position the substance, when placed within the storage cavity of the nipple, is contained; wherein in a mixing position, the substance is released from the storage cavity of the nipple; and wherein the container transitions from the storage position to the mixing position upon application of an external force to the nipple, causing the nipple to deform and the lid to disengage the open end of the nipple.

11 Claims, 5 Drawing Sheets

FEEDING NIPPLE CONTAINER

CLAIM OF PRIORITY

This application is being filed as a non-provisional patent application under 35 U.S.C. §111(b) and 37 CFR §1.53(c). This application claims priority under 35 U.S.C. §111(e) to U.S. provisional patent application Ser. No. 61/675,873, filed Jul. 26, 2012, entitled "Feeding Nipple Container" the contents of which are incorporated herein by reference

FIELD OF THE INVENTION

The invention relates an infant feeding container nipple. In particular, the present invention is directed to storing, mixing and dispensing a predetermined dose of a composition.

The predetermined dose of the composition may be a powder or liquid. For example, the powder or liquid may be a nutritional infant or adult formula powder form.

BACKGROUND OF THE INVENTION

Traditionally, when an adult travels with an infant from their home, it is essential to pack and carry numerous bulky and cumbersome baby products. In particular, it is necessary to pack various items to anticipate the infant's meal, such as, sterile baby bottles, one or more sterile water-filled bottles and various containers of a baby formula powder, a measurement scooper, a bib and baby wipes. The burden of having to carry all of these items to feed the infant when they are hungry (which includes mixing a measured amount of water with a predetermined amount of baby formula powder, using a scoop to put the powder inside the nursing bottle when the user needed to feed the infant), makes traveling anywhere outside of the home discouragingly complicated and an unsatisfying experience.

When baby formula is mixed with water, the recommended time for consumption is within about an hour. Thereafter, it was recommended that the remainder of the formula beverage be discarded to prevent the introduction of bacteria and/or other harmful germs to an infant. (See http://www.ehow.com/how_2514_prepare-ready-mix.html).

In an attempt to extend the use of formula by keeping the ingredients separated until use, various bottle designs have been proposed which have been unsuccessful in providing a simple bottle design that stores, mixes and easily dispenses the beverage.

For example, U.S. Pat. No. 4,264,007 illustrates a top mounted container to hold a small quantity of a second material at the opening of a bottle. This design brings extra and unnecessary parts and requires to be removed from the main container to allow the resulting mixed liquid from being dispensed.

For example, U.S. Pat. No. 5,419,445 illustrates a very complicated baby bottle including an extra cartridge assembly, requiring some extra skills to put all the parts together and definitely increasing the complication related to feeding a baby in a daily regular basis which is repeated up to twelve times per day; as well of other drawbacks related to the use of this design.

U.S. Pat. No. 5,634,714 illustrates a primary container with a removable stemmed plug, which introduces a very high risk of injury for a baby and the possibility of an obstruction while two ingredients are mixing and/or dispensing; as well of other drawbacks found on this design.

U.S. Pat. Nos. 5,692,644, 5,794,802, 5,863,126, and 6,257,428, illustrate other examples of a very complicated devices requiring many extra parts, requiring extra care and capabilities for assembly and disassembly and in some cases representing an injury risk if these devices are used to feed babies. All this and other drawbacks complicate the regular use of a baby bottle, in which a parent is required to load liquid and powdered formula, assemble the bottle, feed the baby and wash these devices up to twelve times every single day.

For at least these reasons, the above devices fail to solve the problem of efficiently storing, mixing and dispensing of a formula beverage.

SUMMARY OF THE INVENTION

An object of the present invention is to provide a nipple container for a dispensing unit for storing, mixing and dispensing of a beverage.

The nipple container may include a vent system to allow air to enter to the nipple container as fluid is removed.

Another object of this invention is to provide a nursing bottle including the nipple container, that stores a predetermined amount of powder formula and a main container including a predetermined amount of water or liquid. In a stored position, a lid seals an open end of the nipple container in communication with the main container, and prevents the powder and liquid from mixing. The lid is released by applying an external deformational force on an exterior surface of the nipple feeding container and the powder and the liquid are allowed to mix.

A further object of this invention is to provide for an improved mixing process between powder and liquid through use of the releasable lid as an agitator.

This invention solves the longstanding need for providing a simple, ready to use, quick and portable sterile nursing dispenser.

These and other objects, features, and/or advantages may accrue from various aspects of embodiments of the present invention, as described in more detail below.

Although the invention is illustrated and described herein in the various exemplary embodiments provided, it is nevertheless not intended to be limited to only the details shown, since various modifications and structural changes may be made therein without departing from the spirit of the invention and within the scope and range of equivalents of the claims.

BRIEF DESCRIPTION OF THE DRAWINGS

Various exemplary embodiments of this invention will be described in detail, wherein like reference numerals refer to identical or similar components or steps, with reference to the following figures. Likewise, some of the figures herein depict minimal line-work for ease of understanding.

DETAILED DESCRIPTION OF THE INVENTION

Particular embodiments of the present invention will now be described in greater detail with reference to the figures.

Figure 1:
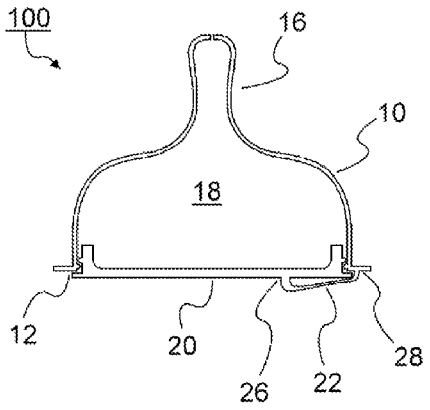
FIGS. 1, 2 and 2A illustrate exemplary side section and perspective views respectively of a dispensing nipple container including a dispensing nipple, a container lid and a lid tether in accordance with and embodiment of this invention.
Figure 2:
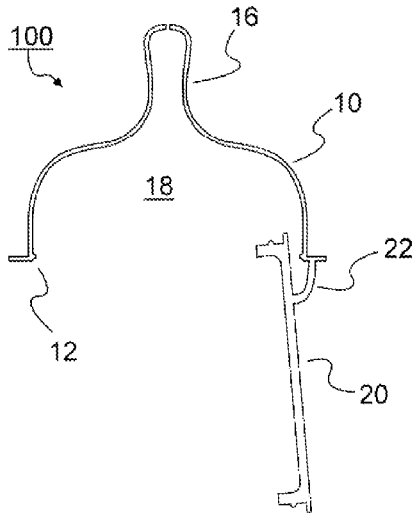
Figure 2A:
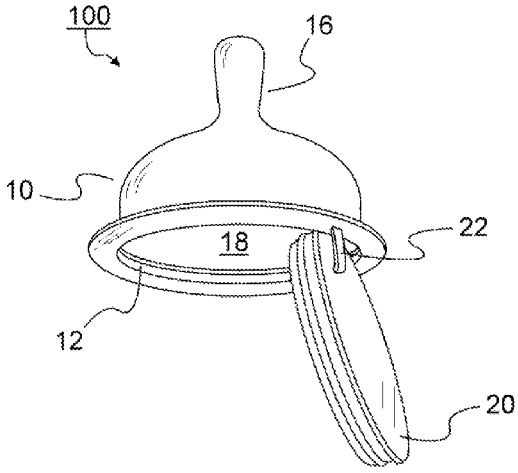

FIGS. 1, 2 and 2A illustrate side section and perspective views respectively of a feeding nipple container 100. The feeding nipple container 100 is constructed to separate, store, mix and/or dispense a baby formula powder or any other type of ingredient. In more detail, the feeding nipple container 100 illustrates an open end 12, an inner cavity 18 and a nipple tip 16 of a nipple body 10, a lid tether 22 and a container lid 20, all as part of an integral unitary piece.

In particular, FIG. 1 shows the feeding nipple container 100 in the storage position, in which the container lid 20 is secured to the open end 12 of the nipple body 10. FIGS. 2 and 2A show the feeding nipple container 100 in the mixing or open position. The container lid 20 is integrated to the nipple body 10 by the lid tether 22. In the storage position, the lid tether 22 is stretched so as to act as spring biased to urge the container lid 20 to open upon release of the lid locking features 60,62 (see FIG. 2B). The lid tether 22 also keeps the container lid 20 open after the container lid 20 has been released from the open end 12 in the mixing position.

Figure 2B:
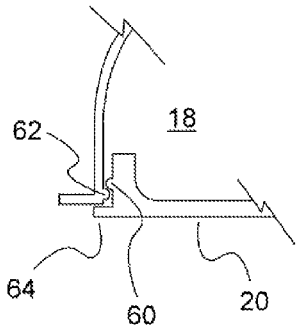
FIG. 2B is a partial enlarged detail view of FIG. 1 which illustrates the features that releasably hold the container lid in a storage (or sealing) position against an inner cavity of the dispensing nipple.

FIG. 2B illustrates in detail the features that keep the container lid 20 in sealing engagement with the open end 12 while in the storage position. As is shown, in the storage position, lid lip 60, which is formed circumferentially around the container lid 20, is prevented from disengaging from the open end 12 by a sealing lip 62 which is formed circumferentially around the open end 12. A retaining flange 64, also formed circumferentially around the container lid 20, prevents the container lid 20 from being forced into the inner cavity 18 of the nipple body 10 upon closing.

Alternative embodiments of the present invention may completely eliminate lid lip 60 and sealing lip 62. In such embodiments, container lid 20 may be kept in sealing engagement with open end 12 by designing the two components so that they engage using an interference fit. In such an arrangement, the circumference of container lid 20 may be slightly larger than the circumference of open end 12 creating a pressure fit between the two upon engagement. The difference in the circumferences of container lid 20 and open end 12 will depend on the type of materials used. In any event, the fit may be designed so that the pressure required to close and open container lid 20 is optimized for the intended use.

Upon application of a releasing force 50 on nipple body 10 (see FIGS. 4 and 6), the sealing lip 62 is deformed and the lid lip 60 is released. As the lid tether 22 pulls on the container lid 20, the container lid 20 opens and releases any baby formula (or other ingredient) stored in the inner cavity 18. If an interference fit is used to maintain sealing engagement between container lid 20 and open end 12, the releasing force 50 will similarly deform open end 12 and simultaneously urge container lid 20 to open.

To hold the necessary amount of baby formula powder to prepare the regular amount of formula beverage for a baby, a cavity size of at least 2 cubic inches of capacity for the inner cavity 18 of the nipple body 10 is desirable. A larger or smaller cavity size may be used depending on the intended use of the device or the type of ingredients to be mixed To allow the necessary deformation to release the container lid 20 from the open end 12, a flexible and/or resilient material may be used to manufacture nipple body 10 and tether 22. Desirable materials which are commonly used to make baby bottle nipples, such as rubber (latex) and silicone are acceptable for the disclosed invention, but the invention is by no means limited to such materials. Any material that has sufficient flexibility, resiliency and hardness to retain the proper shape to maintain engagement between the container lid 20 and open end 12, is acceptable. With regard to hardness, materials having a durometer reading between 40 and 60 (using the "Shore A" scale) are known to be suitable to the present application. Again, however, this should not be considered a material limitation for the present invention.

Figure 3:
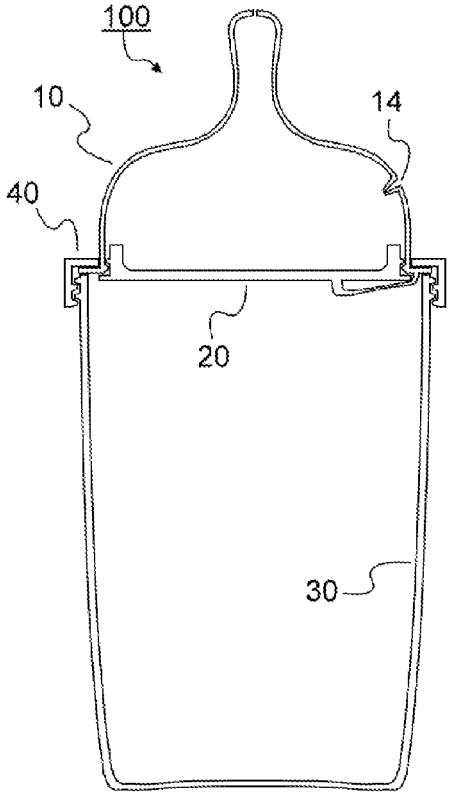
FIGS. 3 and 4 illustrate exemplary side section views of a dispensing nipple container according to the present invention placed on a nursing bottle in a storage and an opened (or mixing) position respectively.
Figure 4:
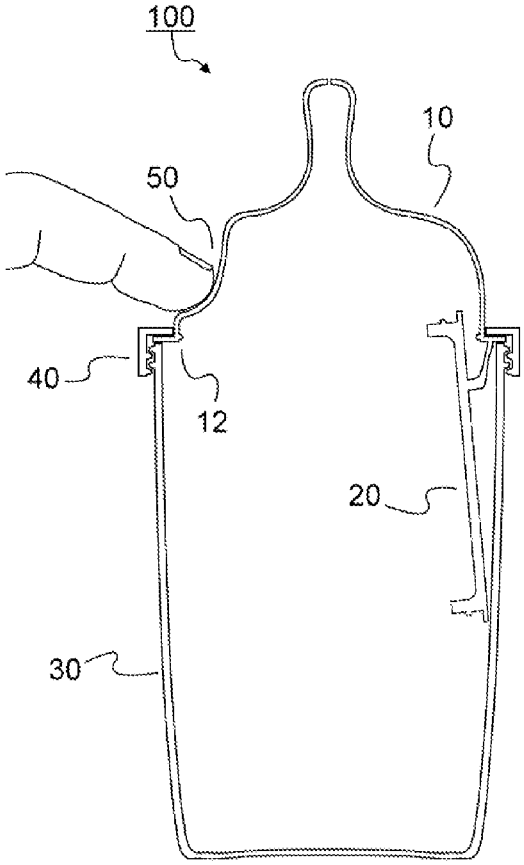

FIGS. 3 and 4 show simple exemplary cross-section side views of the feeding nipple container 100 secured to a cup container 30 by a collar 40.

In particular, FIG. 3 shows an exemplary embodiment of the feeding nipple container 100 in storage position, in which a venting valve 14 is integrated to the nipple body 10 to prevent a vacuum effect when the feeding nipple container 100 is in use.

FIG. 4 shows the feeding nipple container 100 in the mixing position, where the releasing force 50 is applied on the nipple body 10, deforming the shape of the nipple body 10 and forcing the container lid 20 to be released from the open end 12 of the nipple body 10.

FIGS. 5, 6 7 and 8 show simple exemplary views of the feeding nipple container 100 in use and secured to the cup container 30 by a collar 40.

Figure 5:
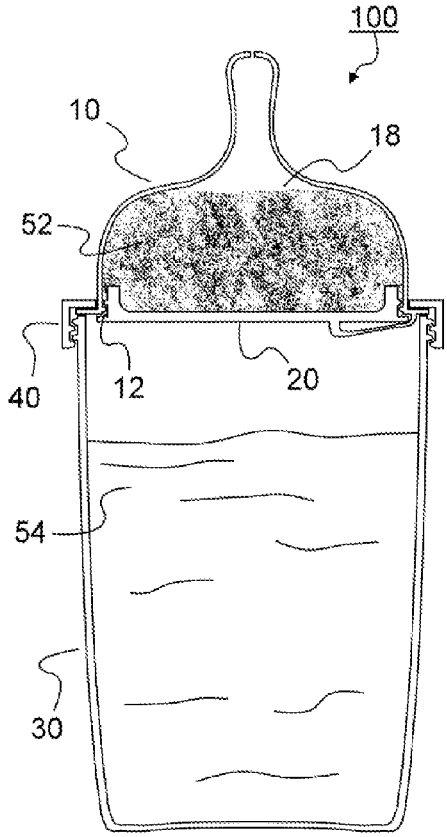
FIG. 5 illustrates an exemplary side section view of a dispensing nipple container according to the present invention placed on a nursing bottle in a storage position.

In particular, FIG. 5 shows the feeding nipple container 100 in the storage position; in which a first substance is disposed in the inner cavity 18 the nipple body 10; and the container lid 20 is secured to the open end 12 of the nipple body 10 and preventing to mix the first material 52 from mixing with the second material 54 disposed inside the cup container 30.

Figure 6:
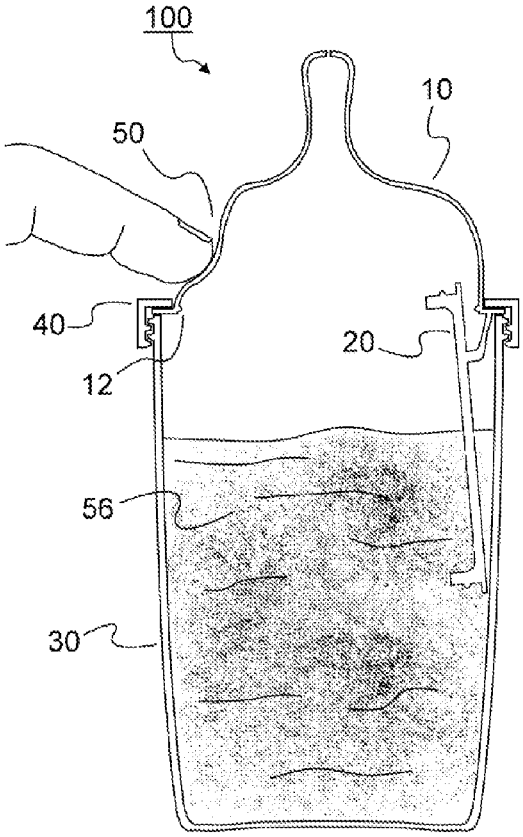
FIG. 6 illustrates an exemplary side section view of a dispensing nipple container according to the present invention placed on a nursing bottle at the moment of release.

FIG. 6 shows the nipple container 100 in the mixing position, in which the releasing force 50 is deforming the shape of the nipple body 10, forcing to release the container lid 20 from the open end 12 of the nipple body 10, allowing the first substance 52 and the second substance 54 (as shown in FIG. 5) to mix into a composition 56.

According to this exemplary embodiment, the nipple body 10 may hold a variety of different substances, including but not limited to: a powder or a liquid, such as: a powdered formula (e.g., an infant formula), and/or any other type of liquid or powdered beverage drink additive (such as tea, punch, sports hydration drink). Likewise, the cup container 30 may also be filled with variety of different substances intended to be mixed with the substance in the nipple body 10 to make a mixed composition, including but not limited to: water, milk and/or any other type of liquid or powder.

Figure 7:
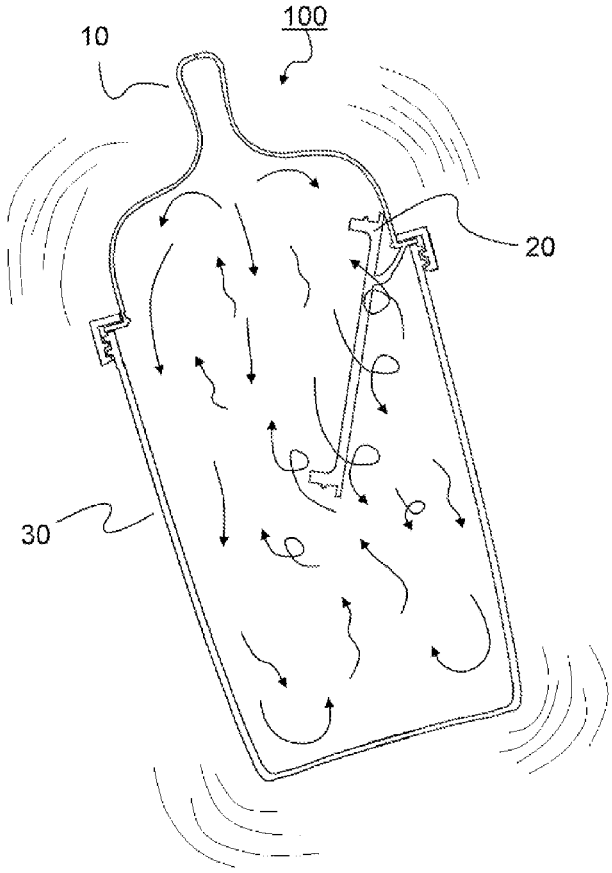
FIG. 7 illustrates an exemplary side section view of a dispensing nipple container according to the present invention placed on a nursing bottle during mixing.

In use, as shown in FIG. 7, the user may then speed up the mixing process by shaking the nipple container 100 secured to the cup container 30 by the collar 40. Here it is shown that container lid 20 also may function as an agitator, helping to uniformly mix the first substance 52 and the second substance 54 into the composition 56.

Figure 8:
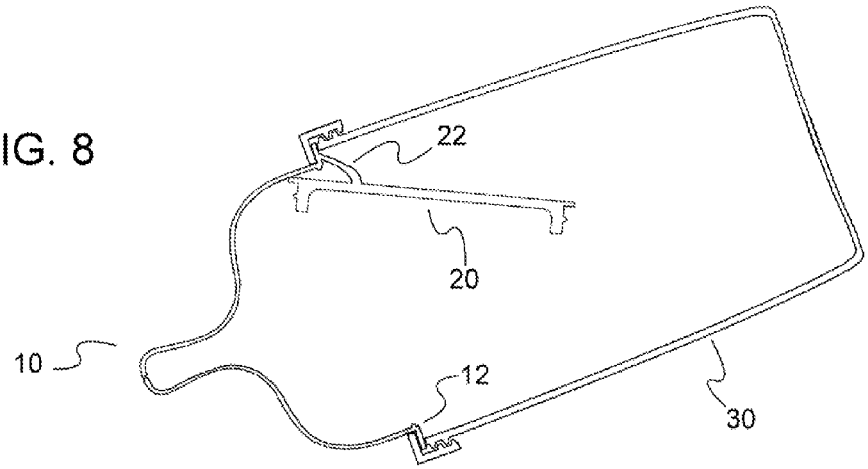
FIG. 8 illustrates an exemplary side section view of a dispensing nipple container according to the present invention placed on a nursing bottle during feeding.

FIG. 8 shows an exemplary section view of the nipple container 100, in which an unlocking feature of the lid tether 22 is shown. The lid tether 22, may be made of a flexible and resilient material and shorter in length that the distance between the attaching point 28 (as shown in FIG. 1) between the nipple body 10 and the tether lid 22, and the attaching point 26 between the container lid 20 and the tether lid 22 in the storage position. Accordingly, the lid tether 22 has to be stretched to allow the container lid 20 to be secured to the open end 12 of the nipple body 10 (as shown in FIGS. 1, 3 and 5) in the storage position. In the storage position, therefore, lid tether 22 acts as a spring urging the container lid 20 to open once the releasing force 50 (as shown in FIGS. 4 and 6) is applied. In use and after the container lid 20 has been released from the open end 12 of the nipple body 10 by the releasing force 50; the tether lid 22 contracts again and prevents the container lid 20 of going back to its previous position at the open end 12 by gravity or shaking (FIGS. 7 and 8), allowing a free flow of the first substance 52, second substance 54 and/or the composition 56 from the nipple body 10 to the cup container 30 or vice versa.

In an alternative embodiment of the present invention, lid tether 22 need not act as a spring or urge the container lid 20 to open or remain disengaged from open end 12. In such an embodiment, the sole purpose of lid tether 22 would be to maintain lid tether 22 attached to the nipple body 10 once it is disengaged from open end 12. Maintaining such an attachment would provide convenience to the user and aid in the agitation function of the container lid 20 (see FIG. 7). In such an embodiment lid tether 22 need not be made of a resilient material and its length may be such that slack is provided when container lid 20 is engaged with open end 12.

In yet another embodiment of the present invention, lid tether 22 can be completely eliminated, and container lid 20 can be a completely separate part from nipple body 10. In such an embodiment, once container lid 20 is forced into disengaging from open end 12, container lid 20 would simply fall into cup container 30 and could be recovered once the cup contents are emptied.

Figure 9:
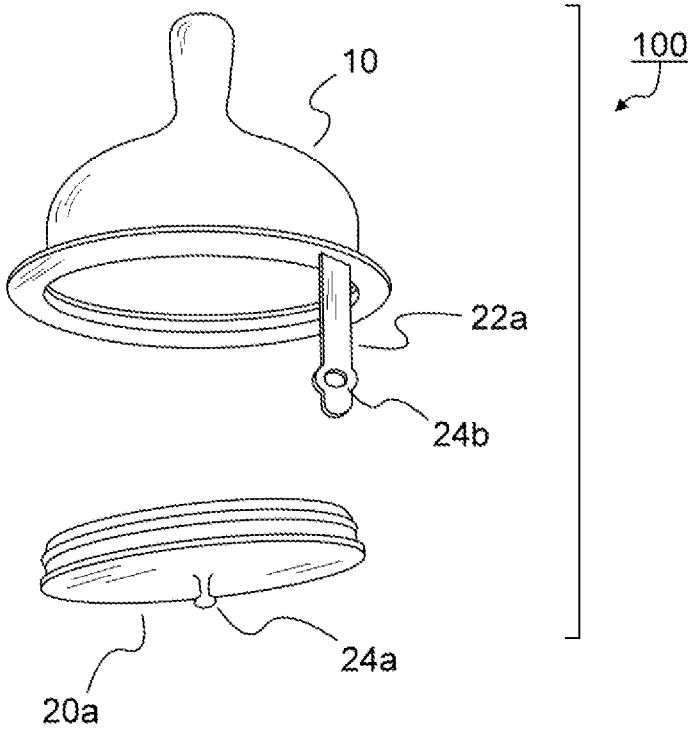
FIGS. 9 and 10 illustrate exemplary side perspective and section views respectively of an embodiment of a dispensing nipple container according to the present invention including a separate container lid and an attaching tether.
Figure 10:
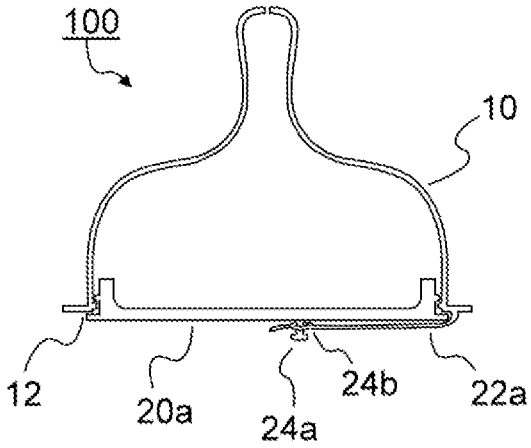

FIGS. 9 and 10 show perspective and section side views respectively of another exemplary embodiment of the nipple container 100, in which the container lid 20 (as shown in FIGS. 1, 2 and 2A) and the nipple body 10 are separated and a modified tether lid 22*a* having a connecting hole 24*b* and a modified lid 20*a* having a connecting pin 24*a* are incorporated to the nipple container 100. In use, the modified lid 20*a* is attached to the nipple body 10 by inserting the connecting pin 24*a* into the connecting hole 24*b* of the modified tether 22*a*.

Although various exemplary embodiments are shown above, it is to be understood that these examples should not be construed as limiting the scope of the invention but as merely providing illustrations of some of the preferred embodiments of the invention. For example: All parts described can be made of different sizes and/or figures. Parts and/or sections of parts can be separated in different parts to create other parts. Parts and/or sections of parts can be replaced by other parts and/or sections of parts.

It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

I claim:

1. A container for storing and dispensing a substance comprising:

a deformable nipple having an open bottom end, a feeding tip, and a storage cavity positioned above the open bottom end of the nipple, the storage cavity being defined by an interior upper wall of the nipple and a lid that is connected to a part of the nipple using a tether so that the storage cavity does not extend below the open bottom end of the deformable nipple; and a tether connecting the nipple to the lid;

wherein the lid is adapted to releasably engage the open bottom end of the nipple to be moveable between a storage position and a mixing position;

wherein, in the storage position, the lid is disposed in sealing engagement to the open end bottom end of the nipple so as to form a bottom portion of the storage cavity adjacent to the bottom end of the nipple, wherein in the mixing position, the lid is disengaged from the open bottom end of the nipple to allow the substance to be released from the storage cavity of the nipple; and wherein the container transitions from the storage position to the mixing position upon application of an external force to the nipple, causing the nipple to deform and the lid to be moved from the storage position to the mixing position by being disengaged from the open bottom end of the nipple.

2. The container of claim 1 further comprising a valve for venting the storage cavity of the nipple to the atmosphere.

3. The container of claim 1 wherein the lid further comprises a connecting pin and the tether further comprises a connecting hole and the lid and tether are connected by inserting the connecting pin in the connecting hole.

4. The container of claim 1 further comprising: a cup having a closed bottom and an open top; a collar adapted to releasably secure the nipple to the open top of the cup; wherein, when the nipple is secured to the open top of the cup, the feeding tip is accessible from the exterior of the cup, the lid is contained within the cup, and, when in the mixing position, the substance is released to the interior of the cup.

5. A container for storing and dispensing a substance comprising:

a deformable nipple having an open bottom end, a feeding tip and a storage cavity;

a lid adapted to releasably engage the open bottom end of the nipple and moveable between a storage position and a mixing position; and a tether having resilient properties, the tether connecting the nipple to the lid;

wherein the storage cavity is defined by an interior upper wall of the nipple and the lid so that the storage cavity does not extend below the open bottom end of the nipple;

wherein, in the storage position, the tether is stretched upon engagement of the lid to the open bottom end of the nipple;

wherein in the storage position, the tether urges the lid to disengage from the open bottom end of the nipple;

wherein in the mixing position, the tether contracts upon disengagement of the lid from the open bottom end of the nipple to allow the substance to be released from the storage cavity of the nipple;

wherein in the mixing position the tether urges the lid against reengaging with the open end of the nipple; and wherein the container transitions from the storage position to the mixing position upon application of an external force to the nipple, causing the nipple to deform and the lid to be moved from the storage position to the mixing position by being disengaged from the open bottom end of the nipple.

6. The container of claim 5 further comprising a valve for venting the storage cavity of the nipple to the atmosphere.

7. The container of claim 5 wherein the lid further comprises a connecting pin and the tether further comprises a connecting hole and the lid and tether are connected by inserting the connecting pin in the connecting hole.

8. The container of claim 5 further comprising: a cup having a closed bottom and an open top; a collar adapted to releasably secure the nipple to the open top of the cup; wherein, when the nipple is secured to the open top of the cup, the feeding tip is accessible from the exterior of the cup, the lid is contained within the cup, and, when in the mixing position, the substance is released to the interior of the cup.

9. A container for storing and dispending a substance comprising:

a deformable nipple having an open bottom end, a feeding tip and a storage cavity positioned above the open bottom end of the nipple, the storage cavity being defined by an interior upper wall of the nipple and a lid that is connected to a part of the nipple so that the storage cavity does not extend below the open bottom end of the nipple;

wherein the lid is adapted to releasably engage the open bottom end of the nipple, and moveable between a storage position and a mixing position;

wherein, in the storage position, the lid is disposed in sealing engagement to the open bottom end of the nipple so as to form a bottom portion of the storage cavity adjacent to the open bottom end of the nipple;

wherein in the mixing position, the lid is disengaged from the open bottom end of the nipple to allow the substance to be released from the storage cavity of the nipple; and wherein the container transitions from the storage position to the mixing position upon application of an external force to the nipple, causing the nipple to deform and the lid to be moved from the storage position to the mixing position by being disengaged from the open bottom end of the nipple.

10. The container of claim 9 further comprising a valve for venting the storage cavity of the nipple to the atmosphere.

11. The container of claim 9 further comprising: a cup having a closed bottom and an open top; a collar adapted to releasably secure the nipple to said open top of the cup; wherein, when the nipple is secured to the open top of the cup, the feeding tip is accessible from the exterior of the cup, said lid is contained within the cup, and, when in said mixing position, the substance is released to the interior of the cup.

* * * * *